US006842156B2

(12) United States Patent
Shepherd et al.

(10) Patent No.: US 6,842,156 B2
(45) Date of Patent: Jan. 11, 2005

(54) ELECTROMAGNETIC SUSCEPTIBILITY TESTING APPARATUS

(75) Inventors: Donald R. Shepherd, Landsale, PA (US); Frank A. Bohar, Landsale, PA (US)

(73) Assignee: Amplifier Research Corporation, Souderton, PA (US)

( * ) Notice: Subject to any disclaimer, the term of this patent is extended or adjusted under 35 U.S.C. 154(b) by 14 days.

(21) Appl. No.: 10/211,821

(22) Filed: Aug. 2, 2002

(65) Prior Publication Data

US 2003/0034931 A1 Feb. 20, 2003

Related U.S. Application Data

(60) Provisional application No. 60/311,584, filed on Aug. 10, 2001.

(51) Int. Cl.[7] ..... H01Q 11/10
(52) U.S. Cl. ..... 343/792.5; 343/803
(58) Field of Search ..... 343/742.5, 803

(56) References Cited

U.S. PATENT DOCUMENTS

| | | | | |
|---|---|---|---|---|
| 1,910,147 A | | 5/1933 | Bruce | |
| 3,210,767 A | | 10/1965 | Isbell | |
| 3,389,396 A | | 6/1968 | Minerva et al. | |
| 3,573,839 A | | 4/1971 | Parker | |
| 3,596,272 A | | 7/1971 | Blonder | |
| 3,618,103 A | * | 11/1971 | Ringland | 343/727 |
| 3,696,437 A | * | 10/1972 | Grant | 343/792.5 |
| 3,697,999 A | * | 10/1972 | Cory et al. | 343/763 |
| 3,732,572 A | | 5/1973 | Kuo | |
| 4,460,895 A | | 7/1984 | Bert | |
| 4,630,063 A | * | 12/1986 | Kuo | 343/792.5 |
| 4,673,948 A | | 6/1987 | Kuo | |
| 4,754,287 A | | 6/1988 | Shelton et al. | |
| 4,907,011 A | | 3/1990 | Kuo | |
| 5,057,850 A | | 10/1991 | Kuo | |
| 5,900,844 A | | 5/1999 | Hill | |
| 5,945,962 A | | 8/1999 | Harrington et al. | |
| 6,057,805 A | | 5/2000 | Harrington | |
| 6,094,176 A | * | 7/2000 | Van Hoozen et al. | 343/792.5 |

OTHER PUBLICATIONS

Practical Testing in the TC1000 and TC2000 for Radiated Emissions (date and author unknown).
Amplifier Research advertisement entitled "Sizcometry", 1998.

* cited by examiner

*Primary Examiner*—Tho Phan
(74) *Attorney, Agent, or Firm*—Howson and Howson

(57) ABSTRACT

Frequency-dependent phase center movement in near-field, unshielded, electromagnetic susceptibility testing using a log-periodic dipole can be significantly reduced by bending the rearmost dipole elements forward. Each bent dipole element has an inner portion and an outer portion connected to each other at a bend, the inner portion extending outward from a boom in substantially perpendicular relation to the boom, and the outer portion extending obliquely outward and forward from the bend. The frequency range of the antenna can be extended by forming each element of the longest dipole with an undulating shape when viewed in a direction along the boom.

10 Claims, 12 Drawing Sheets

150 MHz

200 MHz

400 MHz 1.0 GHz 1.5 GHz 2.0 GHz 2.5 GHz 3.25 GHz

ELECTROMAGNETIC SUSCEPTIBILITY TESTING APPARATUS

CROSS-REFERENCE TO RELATED APPLICATION

This application claims priority from provisional application No. 60/311,584, filed Aug. 10, 2001

FIELD OF THE INVENTION

This invention relates to electromagnetic susceptibility testing, and more particularly to improvements in broadband, unidirectional antennas of log-periodic dipole design for use in electromagnetic susceptibility testing in the VHF and UHF ranges.

BACKGROUND OF THE INVENTION

Antennas having moderately high gain and a broad bandwidth are particularly useful in electromagnetic susceptibility testing of electronic equipment region because they obviate the movement of the device under test from one test location to another in order to expose the device to radiation at all of the frequencies of interest.

The so-called "log-periodic dipole" antenna is an ideal type of antenna for susceptibility testing over the VHF and UHF ranges not only in the radiating far field region, but also in the radiating near field region, i.e. the region within a distance less than approximately from the antenna. A basic log-periodic dipole antenna $\lambda/2\pi$ from the antenna. A basic log-periodic dipole antenna is described in U.S. Pat. No. 3,210,767, dated Oct. 5, 1965. The antenna is a coplanar dipole array consisting of array of dipoles of progressively increasing length and spacing in side-by-side relationship, the dipoles being fed by a common feeder which extends from a forward end to a rearward end and alternates in phase between successive dipoles. The ratio of the lengths of the successive dipoles is given by $$\frac{L_{(n+1)}}{L_n} = \tau$$

where $L_n$ is the length of any intermediate dipole in the array;

$L_{(n+1)}$ is the length of the adjacent shorter dipole; and $\tau$ is a constant having a value less than 1, preferably from 0.8 to 0.95.

The ratio of the spacings between dipoles is given by $$\frac{\Delta S_{(n+1)}}{\Delta S_n} = \tau$$

where $\Delta S_n$ is the spacing between the dipole having the length $L_n$ and the adjacent larger dipole; and $\Delta S_{(n+1)}$ is the spacing between the dipole having the length $L_n$ and the adjacent smaller dipole. Thus, the lengths of the dipoles, and their spacings, progress logarithmically.

The log-periodic dipole antenna typically has a very broad frequency range, a power gain in the range from 6 to 8 dBi (deciBels over isotropic), and a relatively constant input impedance, allowing it to be utilized for testing over the entire spectrum of interest in most cases. Thus, it is usually unnecessary to move the device under test from one test location to another, or to change antennas for different frequency ranges.

However, even when a conventional log-periodic dipole antenna is used for susceptibility testing, it is frequently necessary to adjust the position of the device under test relative to the antenna, or to adjust the r.f. power fed to the antenna, in order to expose the device to the appropriate field, strength, especially at low frequencies. The problem at low frequencies is that the active region (or phase center), that is, the point on the antenna at which it appears that the field is emanating, moves rearward with decreasing frequency because the longer dipoles, which are more remote from the device under test, come into play.

SUMMARY OF THE INVENTION

The principal object of this invention is to reduce the movement of the active region with variation in frequency, in a susceptibility testing apparatus utilizing a log-periodic dipole antenna. Further objects include the provision, in a susceptibility testing apparatus, of one or more of the following features: broad bandwidth, high gain, high power handling capability, simple assembly, ease of use, small physical size, portability and the capability of use with large test objects.

A preferred electromagnetic susceptibility testing apparatus in accordance with the invention comprises a broadband, unidirectional antenna and a device under test. The antenna comprises an array of dipoles in side-by-side relationship. The dipoles progressively increase in length and spacing from a forward end of the antenna to a rearward end. The dipoles are fed by a common feeder which extends in a direction from the forward end to the rearward end and alternates in phase between successive dipoles. Each dipole comprises two elements extending in opposite directions from the common feeder. The elements of a plurality of adjacent ones of the dipoles, including the longest of the dipoles, are bent so that each element of said plurality has an inner portion and an outer portion connected to each other at a bend. The inner portion extends outward from the feeder in substantially perpendicular relation to the feeder, and the outer portion extends obliquely outward and forward from the inner portion. The device under test is spaced forward of the forward end of the antenna. The space lateral to the antenna, toward which the inner portions of the plurality of adjacent bent dipoles extend, is substantially free of obstructions affecting the antenna radiation pattern.

In a version of the apparatus designed for use over a very broad range of frequencies, including low frequencies, each element of the longest dipole of the antenna has an undulating shape when viewed in a direction along the feeder.

Preferably, the length of the antenna, in the direction of the feeder or boom, is shorter than that of a log-periodic dipole antenna having an equivalent number of dipoles and designed according to conventional log-periodic design procedures. The shortening of the length of the antenna also contributes to the compression of the phase center.

The apparatus has the advantage over testing equipment utilizing conventional log-periodic dipole antennae that the active region of the antenna moves over a relatively small distance with changes in frequency, and consequently testing can be carried out over a broad frequency range, reducing the need to move the device under test and reducing the need to adjust the power level of the amplifier feeding the antenna.

Other objects, details and advantages of the invention will be apparent from the following detailed description when read in conjunction with the drawings.

DETAILED DESCRIPTION OF THE PREFERRED EMBODIMENTS

Figure 3:
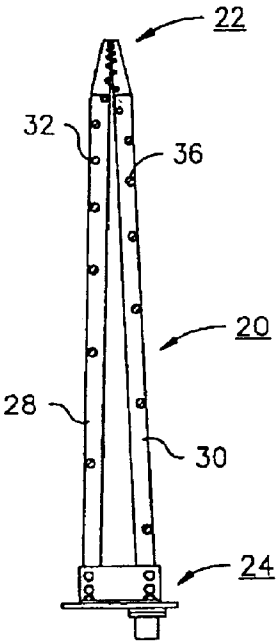
FIG. 3 is a longitudinal section of the antenna taken on plane 3—3 of FIG. 1.
Figure 1:
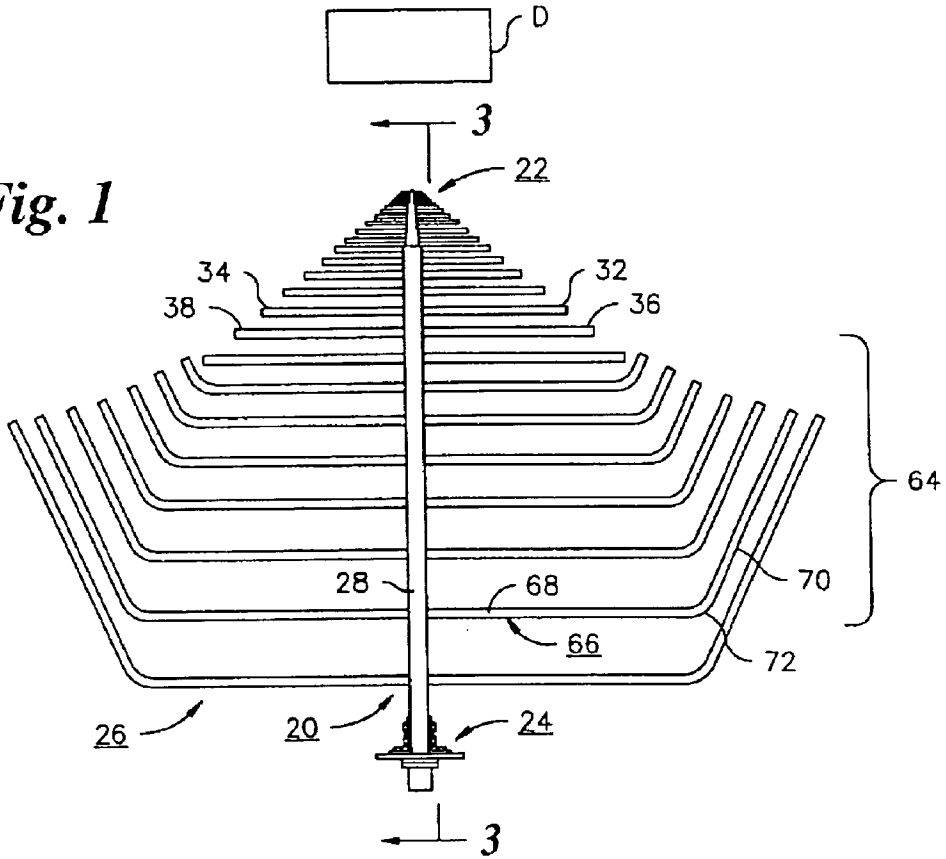
FIG. 1 is a top plan view of a testing apparatus in accordance with a first embodiment of the invention, incorporating a broadband, unidirectional antenna.

As shown in FIGS. 1 and 3, the antenna in accordance with the invention comprises a boom 20, extending longitudinally from a front end 22 to a rear end 24, and elements 26 extending to the left and right of the boom.

As seen in FIG. 3, the boom 20 is composed of a pair of rigid feeder conductors 28 and 30, which extend in spaced, side-by-side relation to each other, in a longitudinal direction, from the front end 22 to the rear end 24. If the antenna elements are horizontal, conductor 28 will be directly above conductor 30. If the antenna elements are vertical, conductors 28 and 30 will be located at the same level. Also, the boom may be pitched or tilted. Accordingly, the term "side-by-side," when used with reference to the feeder conductors, should be understood to mean that the conductors 28 and 30 are generally coextensive, with their forward ends close to each other, and their rear ends similarly close to each other. Although the conductors 28 and 30 of the boom are in side-by-side relationship, the conductors may be somewhat farther apart from each other at the rear end of the boom than at the forward end, as shown in FIG. 3.

Figure 2:
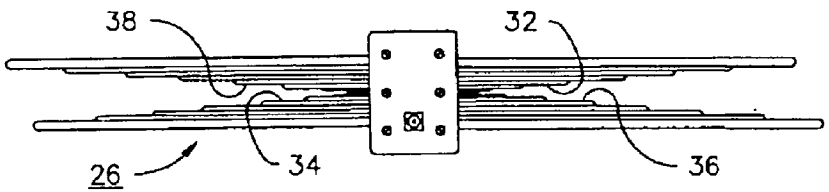
FIG. 2 is a rear elevational view of the antenna.

The antenna elements 26 are preferably disposed in pairs, forming a series of dipoles of increasing length, progressing from the front end 22 to the rear end 24 of the antenna. The elements of each pair are connected to different boom conductors, and successive elements on each side are connected to alternate boom elements as shown in FIG. 3, so that successive dipoles are in opposite phase relationship. Thus, as shown in FIGS. 1–3, elements 32 and 34, which form one of the dipoles, are connected respectively to boom conductors 28 and 30, while elements 36 and 38, which form the next longer dipole, are connected respectively to conductors 30 and 28.

Although the feeder conductors are disposed in spaced relationship to each other and diverge slightly from each other toward the rear of the antenna, they are close enough together that the dipole elements may be considered to be substantially coplanar, as are the elements in the antennae described in U.S. Pat. No. 3,210,767.

Figure 4:
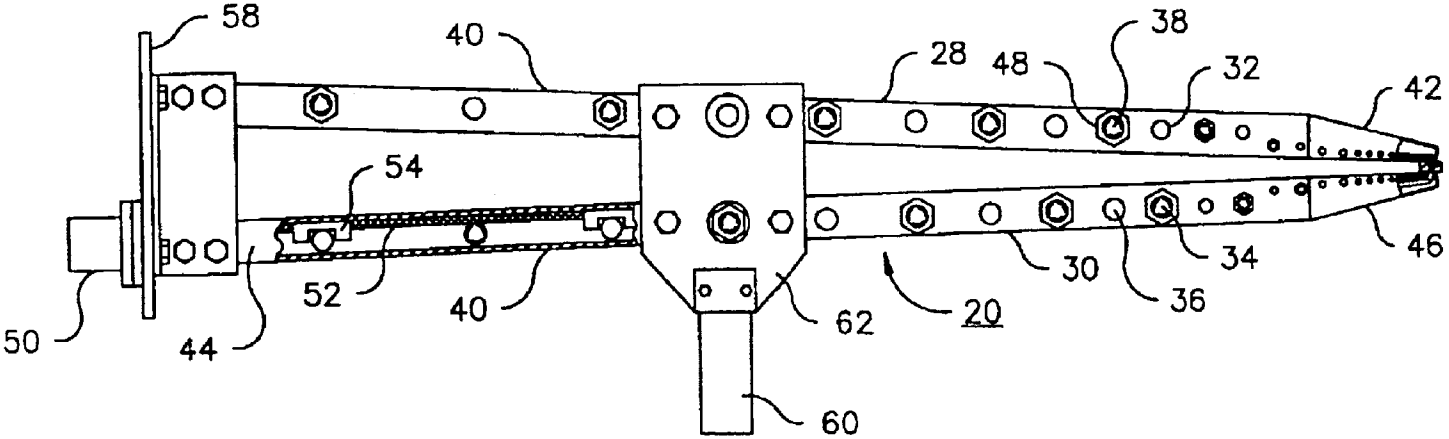
FIG. 4 is a more detailed right side elevational view, partly in section, of the antenna of FIGS. 1–3, showing an insulated, centrally located mounting assembly for supporting the antenna on a mast or tripod.

As shown in FIG. 4, the upper conductor 28 of the boom is composed of a hollow tube 40 of rectangular cross-section, and a hollow, tapered tip 42. The lower conductor 30 is composed of a similar tube 44 and tip 46.

The longer dipole elements of the antenna, e.g. elements 32–38 are threaded at their inner ends and are secured to the tubes of the boom by means of nuts, e.g. nut 48. The shorter dipole elements are preferably threaded directly into, or welded to, the tapered tips of the boom.

A feeder transmission line (not shown) may be connected to a coaxial connector 50. A coaxial line 52 extends longitudinally within tube 44 of the boom. The metal outer conductor the coaxial line is exposed within tube 44 and is clamped to the inner wall of the tube by a series of clamps one of which is seen at 54 in FIGS. 4 and 4*a*. These clamps ensure that the outer conductor of the coaxial line is electrically connected to the lower element of the boom throughout the length of the tube 44.

Figure 4B:
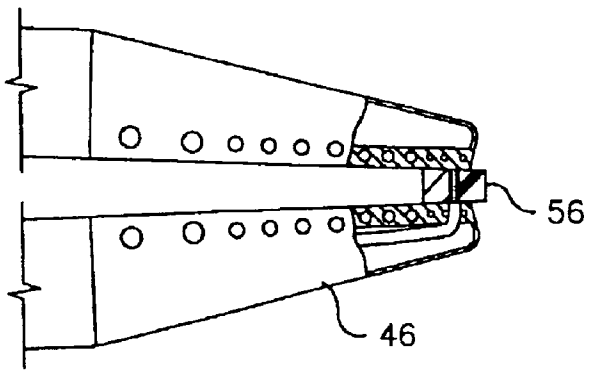
FIG. 4*b* is a fragmentary elevational view, partly in section, showing details of the front end of the antenna.
Figure 4A:
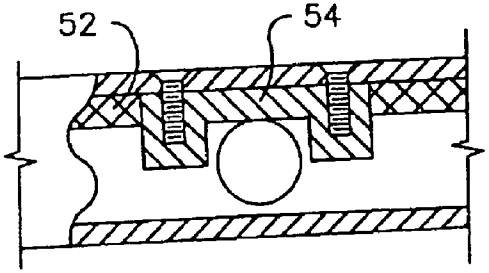
FIG. 4*a* is a sectional view showing details of a clamp securing a coaxial cable against an interior wall of one of the feeder conductors of the antenna.

As shown in FIG. 4*b*, the outer conductor of the portion of the coaxial line inside tapered tip 46 is removed because of the narrow space available inside the tapered tip. The center conductor of the cable extends through a small insulator 56 and is connected directly to the end of tapered tip 42.

The antenna may be supported either by a mounting plate 58 provided at the rear end of the antenna, or on a mast or tripod 60 connected to an insulating mounting block 62 provided at an intermediate location along the length of the antenna.

Returning now to FIG. 2, it will be observed that the several longest dipoles 64 of the antenna are bent. Each element of these dipoles has an inner portion and an outer portion connected to each other at a bend, the inner portion extending outward from the boom in substantially perpendicular relation to the boom, and the outer portion extending obliquely outward and forward from the inner portion. For example, element 66 consists of an inner element 68 which extends perpendicular to boom conductor 28, and an outer element 70, which extends obliquely forward from a bend 72. In the antenna illustrated in FIGS. 1–4, the rearmost seven dipoles are composed of bent elements, whereas the shorter dipoles forward of the rearmost seven dipoles are composed of straight elements.

A device under test (device D) is disposed forward of the front end 22 of the antenna.

The test set-up is essentially an open one, there being no shield or other enclosure surrounding the antenna as in the case of TEM cell. The lateral clearance to the sides of dipoles 64 is such that, even if the elements of these dipoles were straightened, they would not encounter any physical obstructions. Preferably, the space lateral of the antenna is free of any obstructions that would substantially affect the E-plane pattern of the antenna.

The bending forward of the several rearmost dipole elements contributes to the compression of the phase center, that is to the reduction of the rearward movement of the phase center with decreasing frequency. As mentioned previously, it is desirable to make the antenna shorter than a log-periodic dipole antenna of conventional design. The shortening of the length of the antenna also contributes to the compression of the phase center. In the shortened antenna, the lengths of the elements, and their positions, are adjusted empirically so that an acceptable voltage standing wave ratio (VSWR) is maintained over the entire frequency range of the antenna.

Figure 5:
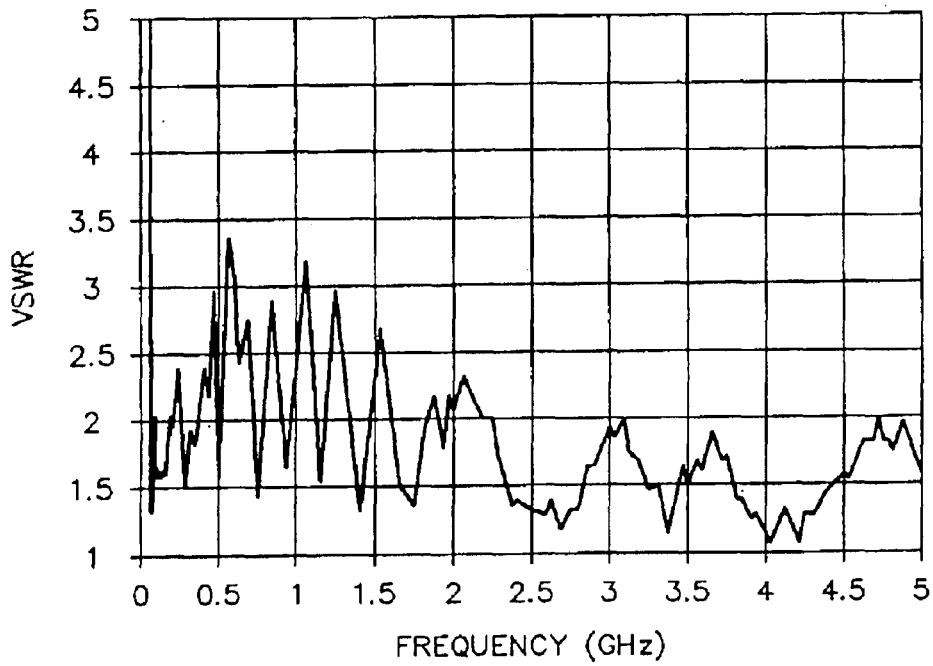
FIG. 5 is a plot of voltage standing wave ratio against frequency for the antenna of FIGS. 1–4.
Figure 6:
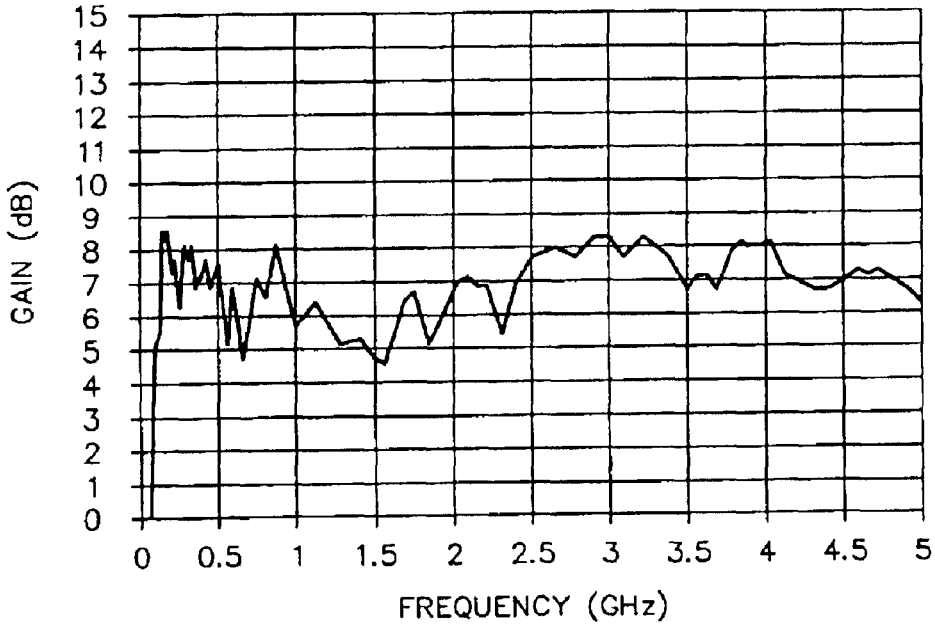
FIG. 6 is a plot of gain against frequency for the antenna of FIGS. 1–4.
Figure 7:
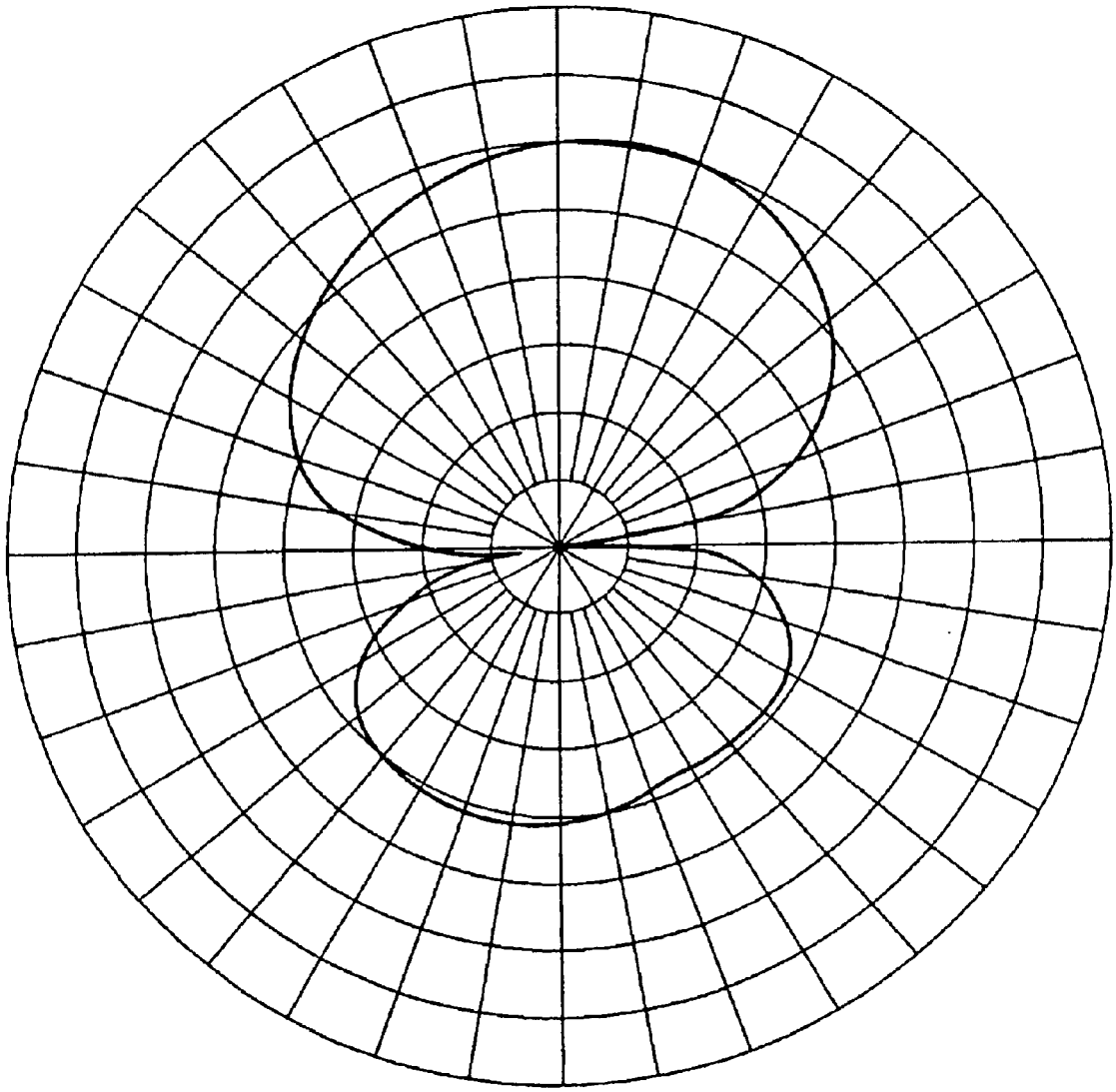
FIGS. 7–14 are polar plots showing the horizontal, or E-plane, radiation patterns of the antenna of FIGS. 1–4 measured at selected frequencies in the range from 150 MHz to 3.25 GHz.
Figure 8:
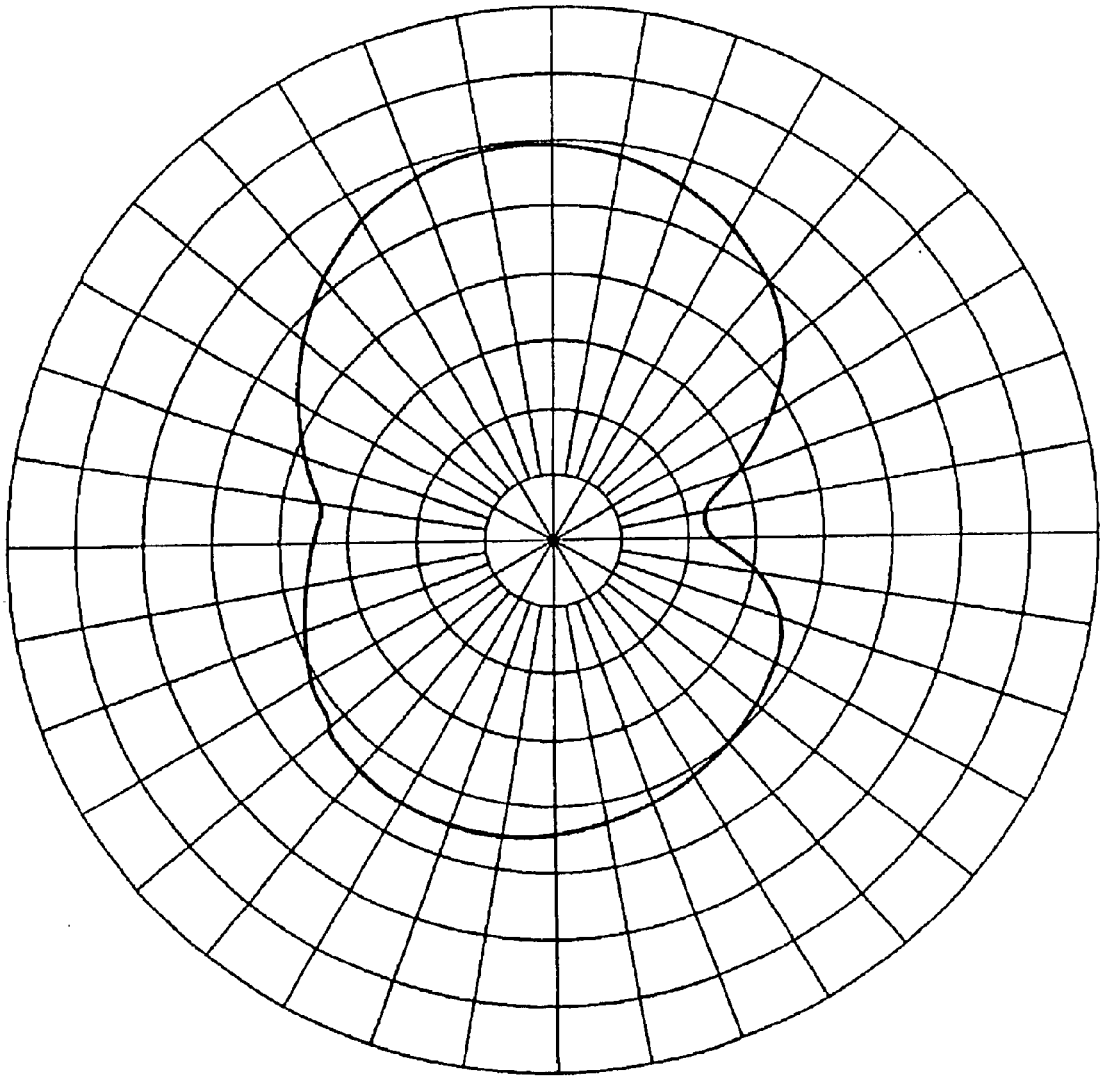
Figure 9:
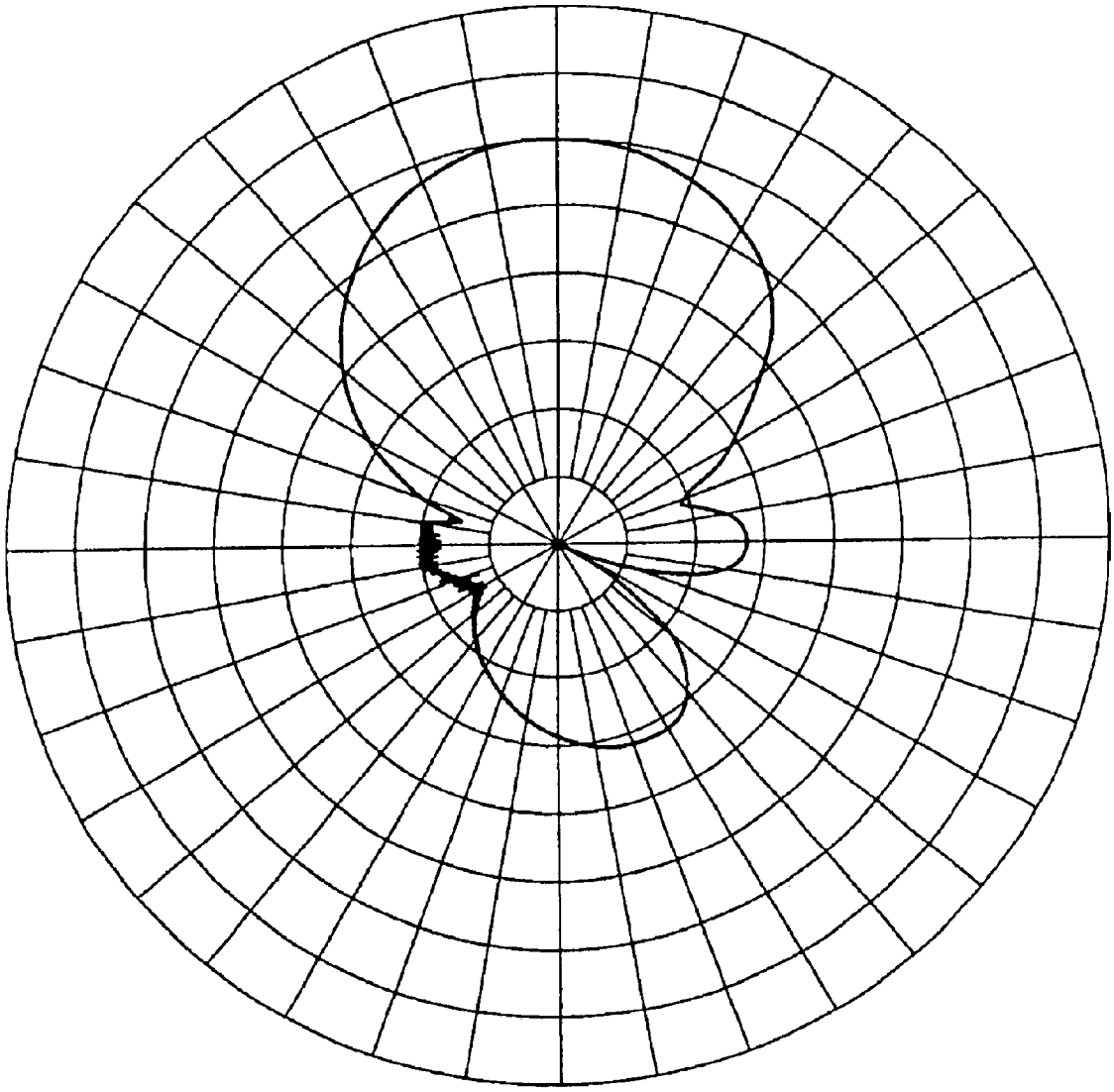
Figure 10:
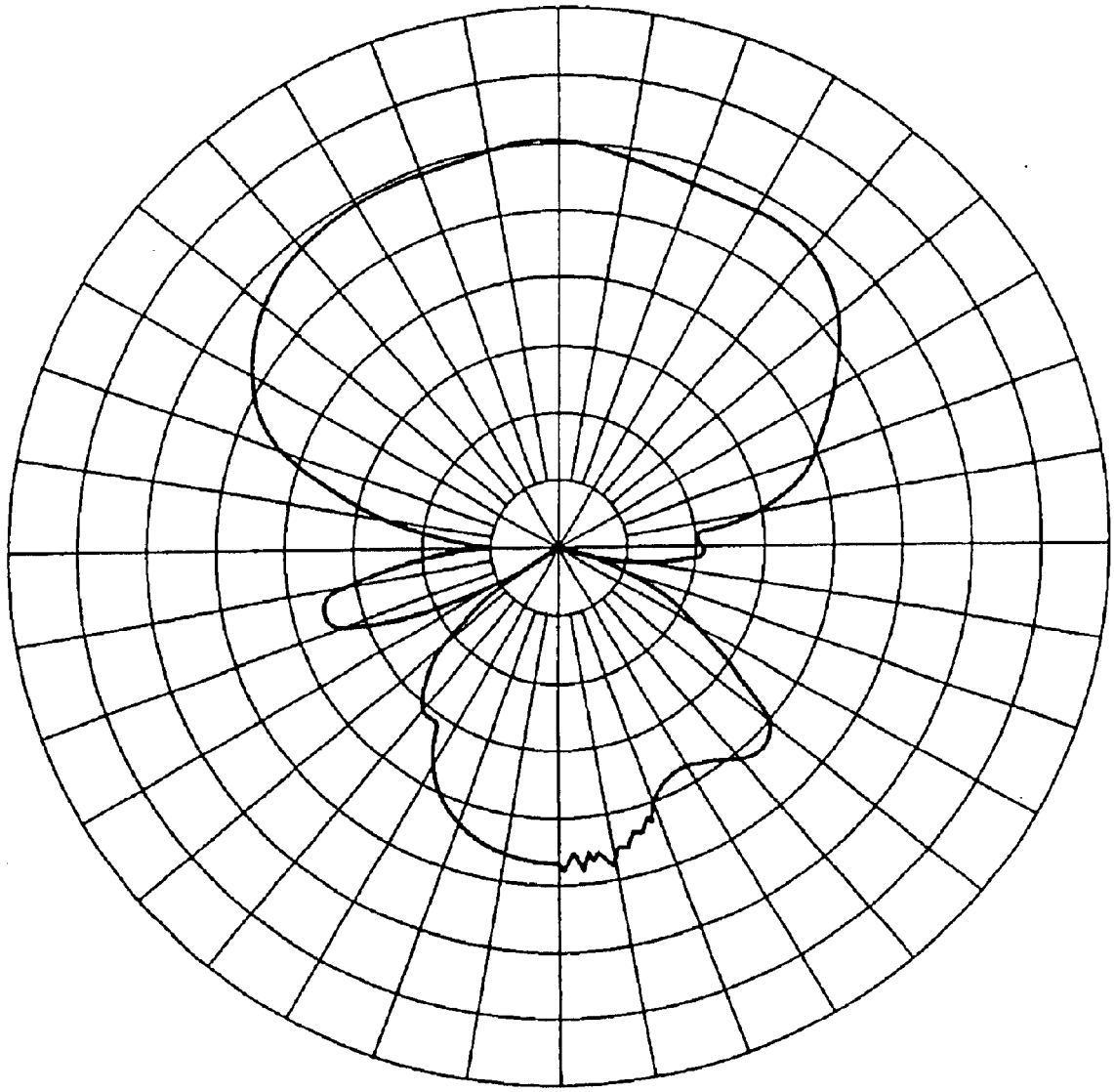
Figure 11:
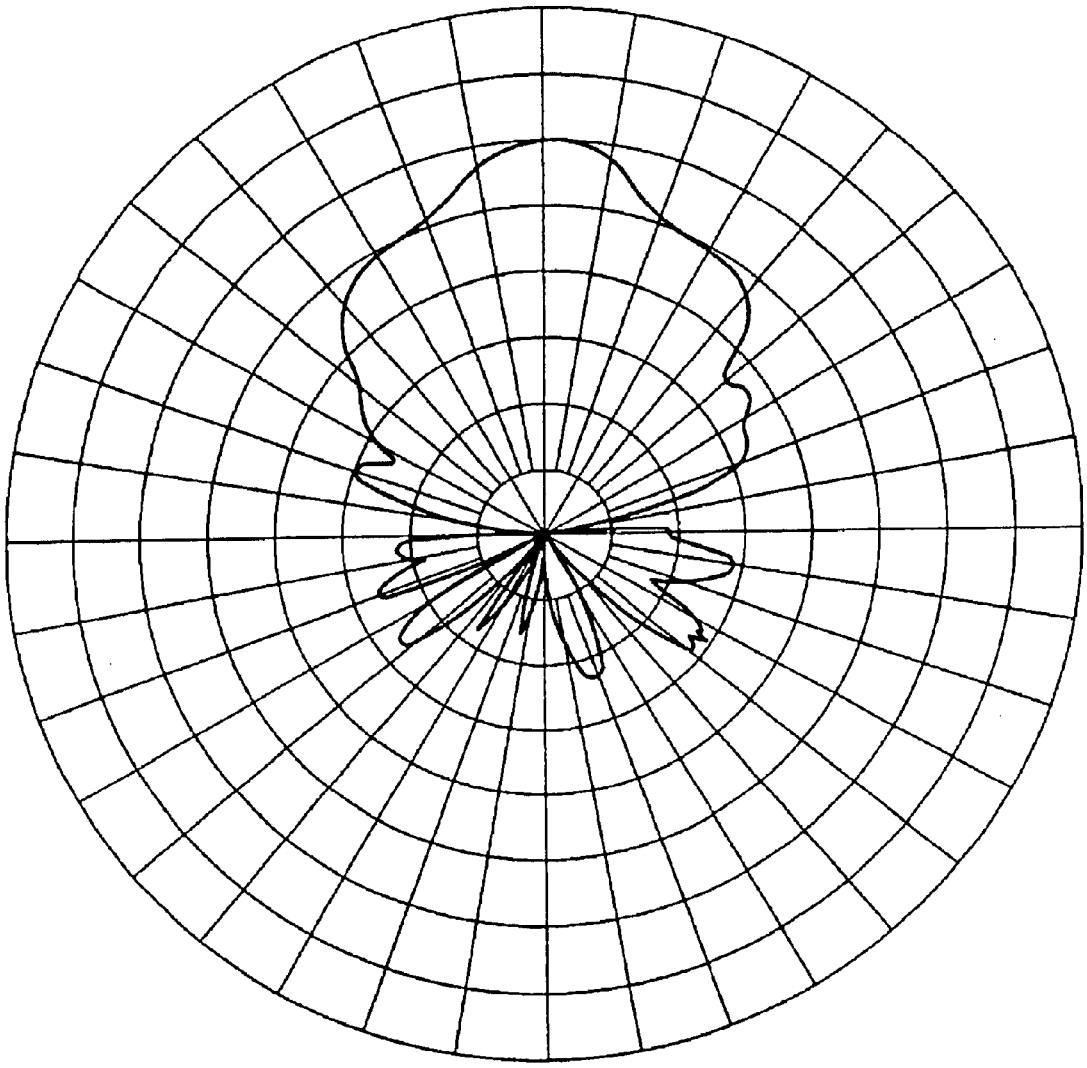
Figure 12:
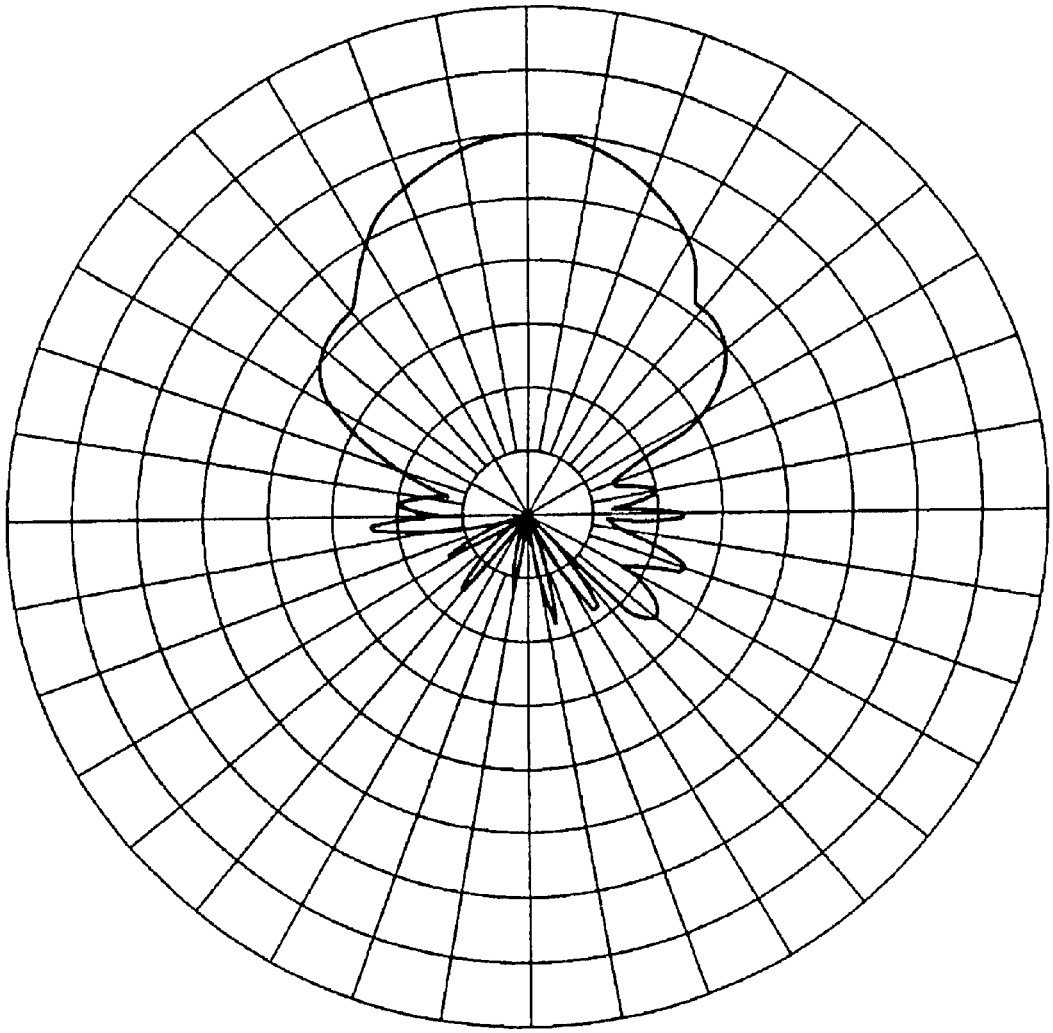
Figure 13:
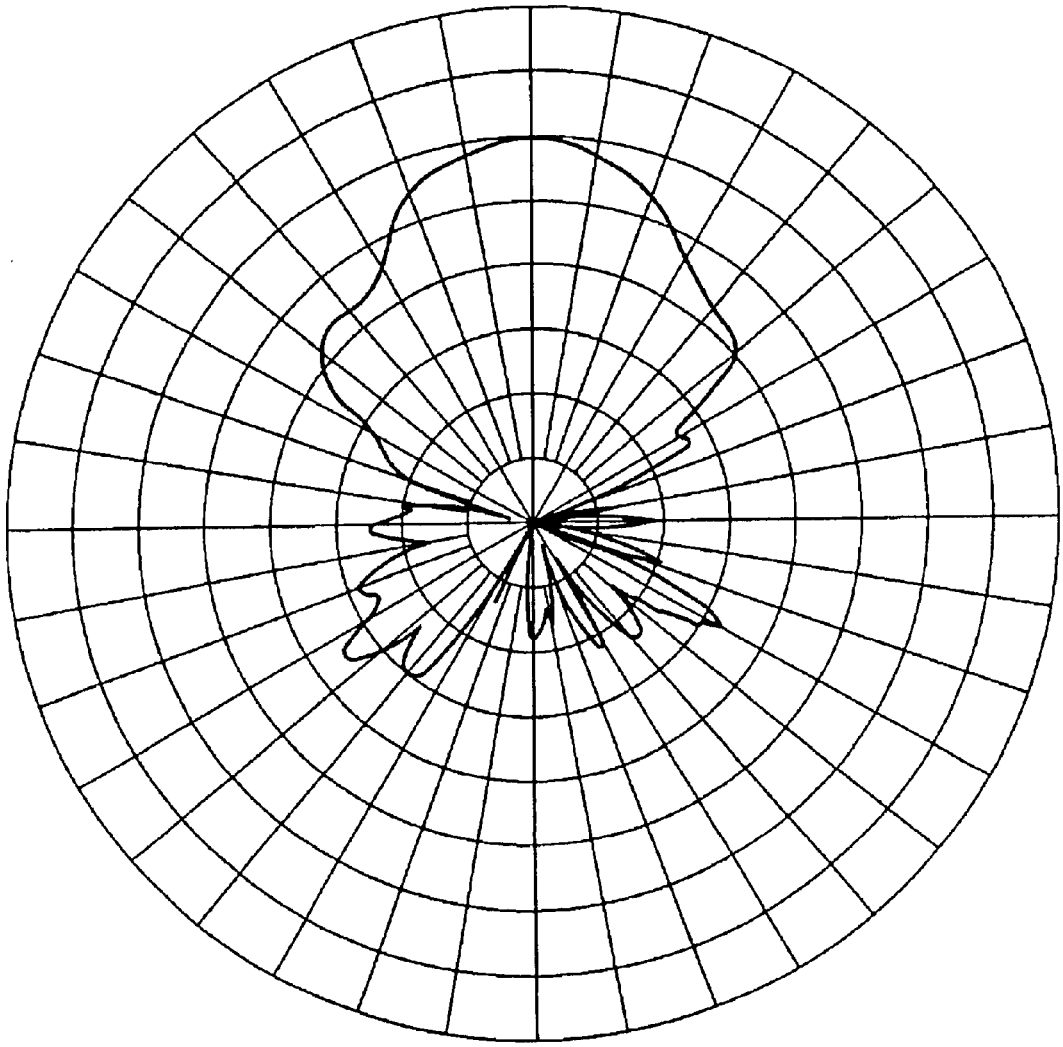
Figure 14:
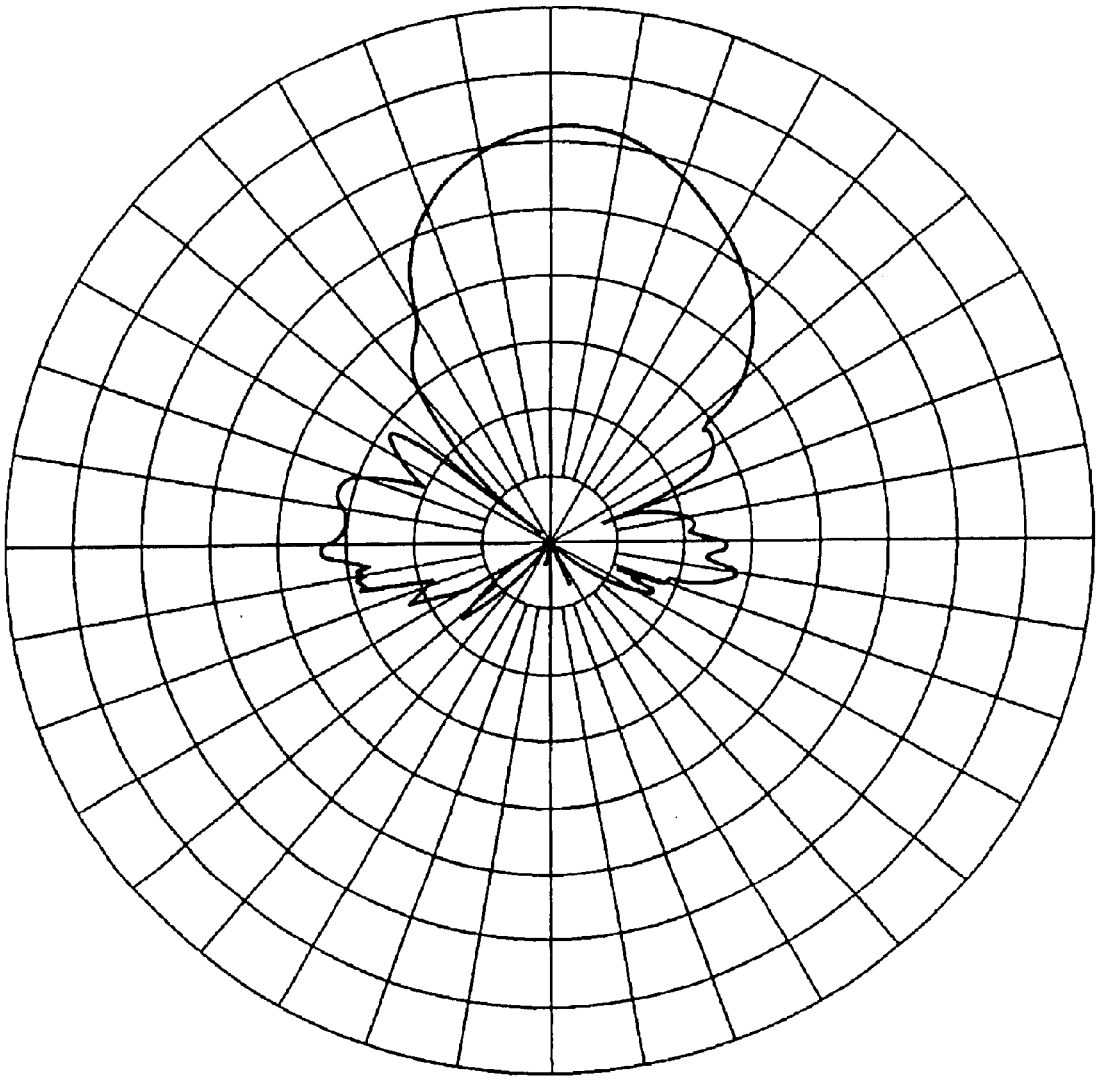

As will be apparent from FIG. 5, the antenna of FIGS. 1–4 has an acceptable voltage standing wave ratio over its entire frequency range of approximately 80 MHz to 5 GHz. The gain is, on the average, greater than 6 dBi over the frequency range, as shown in FIG. 6.

The E-plane antenna patterns, shown in FIGS. 7–14, demonstrate that, although the antenna has a moderately high gain, it also has a relatively broad beamwidth in the forward direction, so that it can accommodate large test objects. The antenna patterns also demonstrate that the field strength forward of the antenna is nearly constant over the entire frequency range. Experiments have shown that, for a given r.f. power level, the measured field strength in volts per meter at one meter, is relatively flat compared to the field strength measured for a conventional log periodic dipole antenna. With the conventional antenna, field strength drops off gradually with decreasing frequency. In contrast, in the antenna of FIGS. 1–4, the forwardly bent dipole elements effectively keep the effective radiation point (i.e., the phase center) of the antenna within a narrower range in the front to back direction. Consequently, the field strength does not drop off with decreasing frequency.

Figure 17:
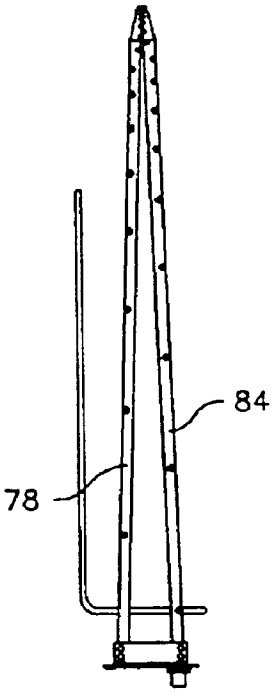
FIG. 17 is a sectional view taken on plane 17—17 in FIG. 15.
Figure 16:
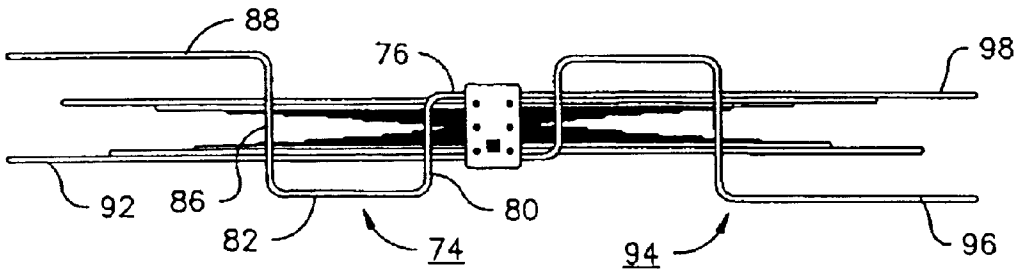
FIG. 16 is a rear elevational view thereof.
Figure 15:
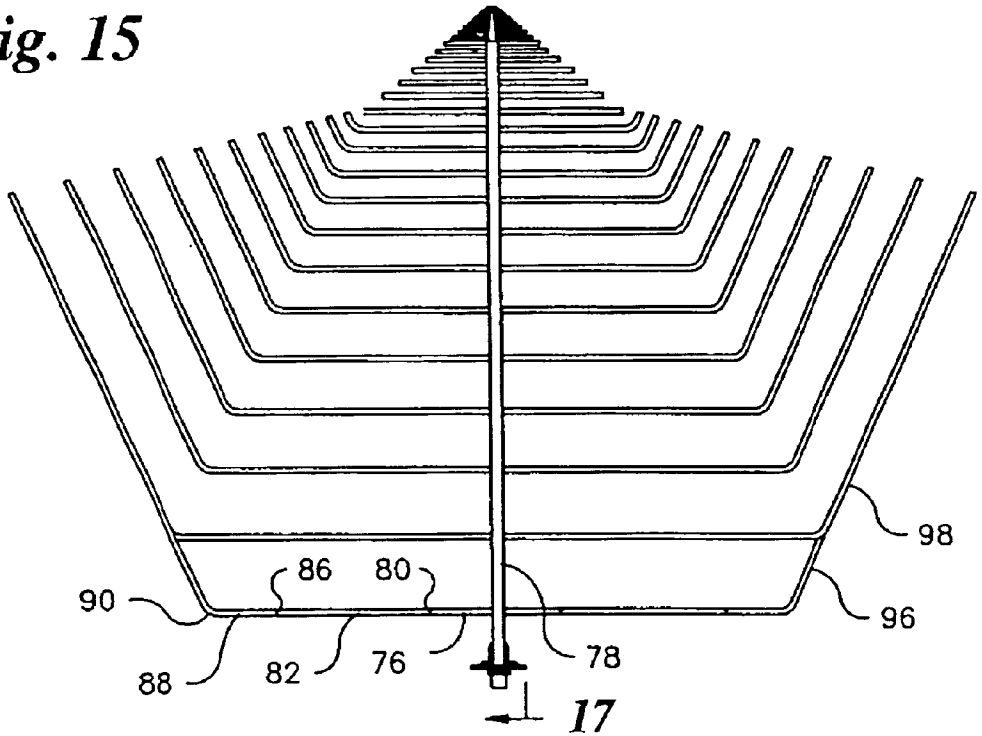
FIG. 15 is a top plan view of a broadband, unidirectional antenna in accordance with a second embodiment of the invention.

The alternative embodiment depicted in FIGS. 15–17 is similar to the embodiment of FIGS. 1–4 except that it has a greater number of bent dipoles and the rearmost dipole has an undulating shape when viewed in a direction along the feeder.

As seen in FIG. 16, the rearmost dipole comprises a left-hand element 74 which comprises a short interior part 76, connected to the upper feeder conductor 78, a downwardly extending vertical part 80, a horizontal part 82 located below the lower feeder conductor 84 (FIG. 17), an upwardly extending vertical part 86 and a horizontal part 88, located above the upper feeder conductor. As shown in FIG. 15, part 88 of element 74 is bent at bend 90, so that the outer portion of part 88 extends obliquely outwardly and forwardly, directly above the oblique part 92 of the adjacent left-hand dipole element.

The right-hand element 94 of the rearmost dipole is an inverted version of element 74, and its oblique part 96 is directly below the oblique part 98 of the adjacent right-hand dipole element.

The operation of the antenna of FIGS. 15–17 is similar to that of the antenna of FIGS. 1–4 except that the antenna of FIGS. 15–17 has a broader bandwidth, being capable of operating at lower frequencies. A typical frequency range for the antenna of FIGS. 15–17 is 26 MHz to 5 GHz.

The testing apparatus of the invention may use either version of the antenna, depending on the desired frequency range. The sizes of the antennae and the number of elements, and the number of bent elements may, of course, be modified to achieve desired performance characteristics, using known log-periodic dipole antenna design parameters. Various modifications can be made. For example, the feeder elements can be made parallel to each other. By utilizing a criss-cross feeder configuration, the dipole elements can be made exactly coplanar. Other known techniques, such as those described in U.S. Pat. Nos. 3,573,839, 3,732,572, 4,673,948, 4,754,287, 4,907,011, 5,057,850, 5,945,962 and 6,057,805, can be utilized to foreshorten the longest dipole elements or the longest several dipole elements.

Still other modifications may be made to the apparatus and method described above without departing from the scope of the invention as defined in the following claims.

What is claimed is:

1. An electromagnetic susceptibility testing apparatus comprising:

a broadband, unidirectional antenna comprising an array of dipoles in side-by-side relationship, the dipoles being of progressively increasing length and spacing from a forward end to a rearward end, and being fed by a common feeder which extends in a direction from said forward end to said rearward end and alternates in phase between successive dipoles, and each dipole comprising two elements extending in opposite directions from said common feeder, wherein the elements of a plurality of adjacent ones of said dipoles, including the longest of said dipoles, are bent so that each element of said plurality of adjacent ones of said dipoles has an inner portion and an outer portion connected to each other at a bend, the inner portion extending outward from the common feeder, in substantially perpendicular relation to the common feeder, toward one of two spaces on opposite sides of said common feeder, and the outer portion extending obliquely outward and forward from the inner portion; and a device under test spaced forward of the forward end of the antenna;

wherein each of said two spaces is substantially free of obstructions affecting the antenna radiation pattern, and wherein said spaces on opposite sides of said feeder are free of obstructions that are intersected by an arc centered on the bend of any of the dipoles of said plurality of adjacent ones of said dipoles and extending from a point on the obliquely extending outer Portion thereof to a point alianed with the inner portion thereof.

2. An electromagnetic susceptibility testing apparatus according to claim 1, in which said dipoles are substantially coplanar.

3. An electromagnetic susceptibility testing apparatus according to claim 1, in which, on each side of the feeder, the oblique portions of the bent elements are in substantially parallel relationship to one another.

4. An electromagnetic susceptibility testing apparatus according to claim 1, in which said dipoles are substantially coplanar, and in which, on each side of the feeder, the oblique portions of the bent elements are in substantially parallel relationship to one another.

5. An electromagnetic susceptibility testing apparatus comprising:

a broadband, undirectional antenna comprising an array of dipoles in side-by-side relationship, the dipoles being of progressively increasing length and spacing from a forward end to a rearward end, and being fed by a common feeder which extends in a direction from said forward end to said rearward end and alternates in phase between successive dipoles, and each dipole comprising two elements extending in opposite directions from said common feeder, wherein the elements of a plurality of adjacent ones of said dipoles, including the longest of said dipoles, are bent so that each element of said plurality of adjacent ones of said dipoles has an inner portion and an outer abortion connected to each other at a bend, the inner portion extending outward from the common feeder, in substantially perpendicular relation to the common feeder, toward one of two spaces on opposite sides of said common feeder, and the outer portion extending obliquely outward and forward from the inner portion; and a device under test spaced forward of the forward end of the antenna;

wherein each of said two spaces is substantially free of obstructions affecting the antenna radiation pattern, and wherein each element of the longest dipole of said plurality of adjacent ones of said dipoles has an undulating shape when viewed in a direction along said feeder.

6. An electromagnetic susceptibility testing apparatus comprising:

a boom composed of a pair of rigid conductors extending in spaced, side-by-side, relation to each other in a longitudinal direction from a forward end of the boom to a rearward end of the boom, and being insulated from each other;

a two-conductor transmission line, the conductors of the transmission line being connected respectively to said rigid conductors of the boom at one of said forward and rearward ends of the boom;

a series of dipoles composed of elements extending in transverse relation to the boom, the dipoles being disposed at stations spaced along the length of the boom, each dipole consisting of a first rigid element connected to one of the boom elements at one of said stations and a second rigid element connected to the other of the boom elements at said one of said stations, the elements of each dipole extending transverse to the length of the boom and on opposite sides of the boom, the dipoles being progressively longer, proceeding from the forward end of the boom to the rearward end of the boom, and successive dipoles being in alternating phase relationship to each other;

wherein the elements of a plurality of adjacent ones of said dipoles, including the longest of said dipoles, are bent so that each element of said plurality of adjacent ones of said dipoles has an inner portion and an outer portion connected to each other at a bend, the inner portion extending outward from the boom in substantially perpendicular relation to the boom toward one of two spaces on opposite sides of said boom, and the outer portion extending obliquely outward and forward from the bend; and a device under test spaced forward of the forward end of the boom;

wherein each of said two spaces is substantially free of obstructions affecting the radiation pattern of said apparatus, and wherein said spaces on opposite sides of said boom are free of obstructions that are intersected by an arc centered on the bend of any of the dipoles of said plurality of adjacent ones of said dipoles and extending from a point on the obliquely extending outer portion thereof to a point phoned with the inner portion thereof.

7. An electromagnetic susceptibility testing apparatus according to claim 6, in which said dipoles are substantially coplanar.

8. An electromagnetic susceptibility testing apparatus according to claim 6, in which on each side of the boom, the oblique portions of the bent elements are in substantially parallel relationship to one another.

9. An electromagnetic susceptibility testing apparatus according to claim 6, in which said dipoles are substantially coplanar, and in which, on each side of the boom, the oblique portions of the bent elements are in substantially parallel relationship to one another.

10. An electromagnetic susceptibility testing apparatus comprising:

a boom composed of a pair of rigid conductors extending in spaced, side-by-side, relation to each other in a longitudinal direction from a forward end of the boom to a rearward end of the boom, and being insulated from each other;

a two-conductor transmission line, the conductors of the transmission line being connected respectively to said rigid conductors of the boom at one of said forward and rearward ends of the boom;

a series of dipoles composed of elements extending in transverse relation to the boom, the dipoles being disposed at stations spaced along the length of the boom, each dipole consisting of a first rigid element connected to one of the boom elements at one of said stations and a second rigid element connected to the other of the boom elements at said one of said stations, the elements of each dipole extending transverse to the length of the boom and on opposite sides of the boom, the dipoles being progressively longer, proceeding from the forward end of the boom to the rearward end of the boom, and successive dipoles being in alternating phase relationship to each other;

wherein the elements of a plurality of adjacent ones of said dipoles, including the longest of said dipoles, are bent so that each element of said plurality of adjacent ones of said dipoles has an inner portion and an outer portion connected to each other at a bend, the inner portion extending outward from the boom in substantially perpendicular relation to the boom toward one of two spaces on opposite sides of said boom, and the outer portion extending obliquely outward and forward from the bend; and a device under test spaced forward of the forward end of the boom;

wherein each of said two spaces is substantially free of obstructions affecting the radiation pattern of said apparatus, and wherein each element of the longest dipole of said plurality of adjacent ones of said dipoles has an undulating shape when viewed in a direction along said boom.

* * * * *

UNITED STATES PATENT AND TRADEMARK OFFICE

CERTIFICATE OF CORRECTION

PATENT NO. : 6,842,156 B2
DATED : January 11, 2005
INVENTOR(S) : Donald R. Shepherd and Frank A. Bohar It is certified that error appears in the above-identified patent and that said Letters Patent is hereby corrected as shown below:

Column 6,
Line 32, "Portion" should read -- portion --;
Line 33, "alianed" should read -- aligned --;
Line 60, "abortion" should read -- portion --;

Column 7,
Line 53, "phoned" should read -- aligned --.

Signed and Sealed this

Seventeenth Day of May, 2005

JON W. DUDAS
*Director of the United States Patent and Trademark Office*

UNITED STATES PATENT AND TRADEMARK OFFICE

CERTIFICATE OF CORRECTION

PATENT NO. : 6,842,156 B2
APPLICATION NO. : 10/211821
DATED : January 11, 2005
INVENTOR(S) : Donald R. Shepherd and Frank A. Bohar It is certified that error appears in the above-identified patent and that said Letters Patent is hereby corrected as shown below:

At column 1, in lines 26-29, change "distance less than approximately from the antenna. A basic log-periodic dipole antenna $\lambda/2\pi$ from the antenna." to - -distance less than approximately $\lambda/2\pi$ from the antenna. - -

Signed and Sealed this

Fifth Day of September, 2006

JON W. DUDAS
*Director of the United States Patent and Trademark Office*